United States Patent [19]

Parthasarathy et al.

[11] Patent Number: 5,011,572

[45] Date of Patent: Apr. 30, 1991

[54] TWO STAGE PROCESS FOR THE OXYGEN DELIGNIFICATION OF LIGNOCELLULOSIC FIBERS WITH PEROXIDE REINFORCEMENT IN THE FIRST STAGE

[75] Inventors: V. R. Parthasarathy; Meenaksi Sundaram; Hasan Jameel, all of Raleigh; Josef S. Gratzl, Cary, all of N.C.; Ronald J. Klein, Edison, N.J.

[73] Assignees: FMC Corporation, Philadelphia, Pa.; North Carolina State University, Raleigh, N.C.

[21] Appl. No.: 354,522

[22] Filed: May 19, 1989

[51] Int. Cl.[5] ..... D21C 9/147; D21C 9/16; D21C 9/18

[52] U.S. Cl. ..... 162/56; 162/65; 162/78

[58] Field of Search ..... 162/65, 78, 60, 89, 162/56, 19, 18

[56] References Cited

U.S. PATENT DOCUMENTS

| | | | |
|---|---|---|---|
| 3,719,552 | 3/1973 | Farley | 162/65 |
| 3,874,992 | 4/1975 | Liebergott | 162/66 |
| 4,087,318 | 5/1978 | Samuelson et al. | 162/60 |
| 4,259,150 | 3/1981 | Prough | 162/56 |
| 4,298,427 | 11/1981 | Bentvelzen et al. | 162/65 |
| 4,568,420 | 2/1986 | Nonni | 162/89 |
| 4,806,203 | 2/1989 | Elton | 162/60 |

*Primary Examiner*—Steve Alvo

*Attorney, Agent, or Firm*—R. E. Elden; R. L. Andersen

[57] ABSTRACT

A process is provided for a two-stage oxygen delignification of chemical pulp in which 0.01% to 1% hydrogen peroxide is incorporated into the first and, optionally the second stage. The invention is particularly suitable when the pulp is subsequently bleached with at least one chlorine dioxide stage and at least one hydrogen peroxide stage.

10 Claims, 3 Drawing Sheets

TWO STAGE PROCESS FOR THE OXYGEN DELIGNIFICATION OF LIGNOCELLULOSIC FIBERS WITH PEROXIDE REINFORCEMENT IN THE FIRST STAGE

The present invention is a process for delignifying chemical pulp without an initial chlorination stage.

Effluents from delignifying and bleaching of chemical pulps have become the focus of environmental concern in recent years. Many of the chlorinated organic compounds formed by the use of a chlorine stage and subsequent alkaline extraction have proven to be bioaccumulating and mutagenic. Recent findings of polychlorinated dioxins and furans in the effluent as well as pulp are causing increased environmental concerns.

The formation of organic chlorides is proportional to the consumption of elemental chlorine which depends on the incoming Kappa number of the unbleached pulp. Oxygen delignification is a means to produce low Kappa number pulps which can then be bleached with low chlorine overall use.

The nomenclature used herein is as follows:

0=Oxygen delignification

PO=Hydrogen peroxide reinforced oxygen

EO=Oxygen reinforced alkaline extraction

EP=Peroxide reinforced alkaline extraction (EP)0=Hydrogen peroxide and oxygen reinforced alkaline extraction.

Oxygen delignification of chemical pulps has now been accepted in a number of mills throughout the world. Through the use of oxygen, Kappa number reduction is possible to the extent of 50% or more, compared to the unbleached pulp. Another advantage in oxygen delignification is that the effluent from the stage can be recycled to the chemical recovery system without the detrimental effects of chloride build-up and in doing so, valuable heat energy can be recovered.

Another chemical which is generating increasing interest in nonchlorine bleaching of chemical pulps is hydrogen peroxide. Hydrogen peroxide has been used to bleach groundwood and sulfite pulps for many years, but only recently has it been proposed for bleaching of kraft pulps. U.S. Pat. No. 3,719,552 teaches reinforcing the alkaline extraction or oxygen reinforced alkaline extraction stage with hydrogen peroxide, (EP)0 is useful after a chlorination stage in a kraft bleach sequence for reducing Kappa number and improving viscosity of sulfate pulp.

Hydroperoxyl and hydroxyl radicals which are generated by decomposition of hydrogen peroxide initiate delignification. Hydroxyl radicals are capable of attacking practically all types of organic structures. Hydroxyl radicals are not only responsible for the delignification and oxidation but also for degradation of cellulose. Recently it was reported that addition of $MgSO_4$ to both EO and (EP)0 stages had little effect on Kappa number and brightness, but improved viscosity significantly. There is a great environmental need to delignify chemical pulps without initial chlorination and without concomitant degradation of cellulose indicated by an excessive loss in viscosity.

Little is known regarding oxygen delignification of chemical pulps without initial chlorination. Papageorges et al. in U.S. Pat. No. 4,459,174 demonstrated that depolymerization of cellulose is reduced during oxygen delignification of semi-chemical and chemical pulps by recycling between 5% to 70% by weight of the effluents from a subsequent alkaline peroxide bleaching, which followed the oxygen stage. A similar conclusion was reached by Kruger et al. in U.S. Pat. No. 4,622,319 who disclosed that the recirculation of the effluent from an acidic hydrogen peroxide bleaching to an oxygen stage improved the viscosity of sulfite pulps. The pH for the oxygen delignification was <5.0.

The present invention is an improvement over prior art oxygen delignification processes in that it provides pulp lower in Kappa number (lignin) and higher viscosity (strength) than the prior oxygen delignification process. The invention is a two-stage process for delignifying lignocellulose fibers in a slurry from a digester without significant loss of fiber strength comprising the steps of:

a. thickening the slurry by extracting therefrom a first liquor portion, b. incorporating sufficient thickened slurry from step (a) into a first reaction mixture to provide a consistency of from about 8% to about 25% by weight fibers on an oven dry basis, said reaction mixture also containing sufficient alkalinity to be equivalent to from about 1.5% to about 4% sodium hydroxide and about 0.01% to about 1% of hydrogen peroxide based on the oven dry weight of fibers, c. maintaining the first reaction mixture at a temperature of about 80° C. to about 110° C., for about 30 to about 60 minutes in the presence of molecular oxygen at a partial pressure of about 620 to 860 kPa (75–110 psig), d. thickening the first reaction mixture from step (c) by extracting therefrom a second liquor portion, e. incorporating sufficient thickened slurry from step (d) into a second reaction mixture to provide a consistency of from about 8% to about 25% by weight fibers on an oven dry basis, said reaction mixture also containing sufficient alkalinity to be equivalent to from about 1.5% to about 4% sodium hydroxides, f. maintaining the second reaction mixture at a temperature of about 70° C. to about 110° C., for about 30 to about 60 minutes in the presence of molecular oxygen at a partial pressure of about 170 to 860 kPa (20–110 psig), and g. recovering delignified fibers from the second reaction mixture, said delignified fibers having equal or increased strength compared with fibers delignified by a single oxygen stage.

Optionally, the second reaction mixture also comprises 0.01% to about 1% hydrogen peroxide based on the oven dry weight of the fibers.

Unexpectedly, it was found to be critical in a two-stage oxygen delignification process to incorporate hydrogen peroxide into the first stage to obtain pulps with lower Kappa number and higher viscosity as compared to pulp delignified by an oxygen stage alone.

By reinforcing two oxygen stages with hydrogen peroxide, delignification can be extended to about 75% Kappa number reduction, without significant loss of viscosity.

The addition of hydrogen peroxide at an oxygen stage improves the selectivity of pulps by enhancing delignification. Hydrogen peroxide addition in two-stage oxygen delignifications of high yield pulps (Kappa number≧50) allows producing pulps within a wide range of Kappa numbers without significant viscosity losses. Such pulps exhibit similar or better strength properties than pulps bleached by a single oxygen stage.

The effluents from a multistage PO-PO-D-P process will consequently have negligibly low levels of chlorinated organics such as polychlorinated phenols and dioxins. The scope of the invention is intended to include a process in which a two-stage hydrogen peroxide enhanced oxygen delignification is followed by a chlorine dioxide and a per-oxygen bleaching stage.

The amount of peroxide added to either or both oxygen stage(s) is not critical. Additions of less than 0.5% $H_2O_2$ were preferred to improve the properties of oxygen bleached pulp.

Pulps treated by PO-PO and PO-0 sequences were superior in viscosity than those treated by an 0-PO sequence. The Kappa number reduction and viscosity improvements were achieved at lower caustic charge and lower temperature indicating the potential for savings in chemicals and thermal energy for two-stage PO-PO bleaching.

Viscosity improvements and Kappa reduction are obtained in the peroxide reinforced oxygen delignification over a wide range of temperatures (60° C.–110° C.), preferably 80° C. to 110° C., in the first and 70° C.–110° C., in the second stage oxygen delignification. The benefits from the addition of hydrogen peroxide depend on the modes of its addition. Pulps delignified by hydrogen peroxide reinforced oxygen in the first stage have better properties after second stage oxygen delignification even if this stage is not reinforced with hydrogen peroxide. The increase in viscosity allows the pulp to be delignified by an additional 2 Kappa number unit employing a PO-PO sequence.

Figure 1:
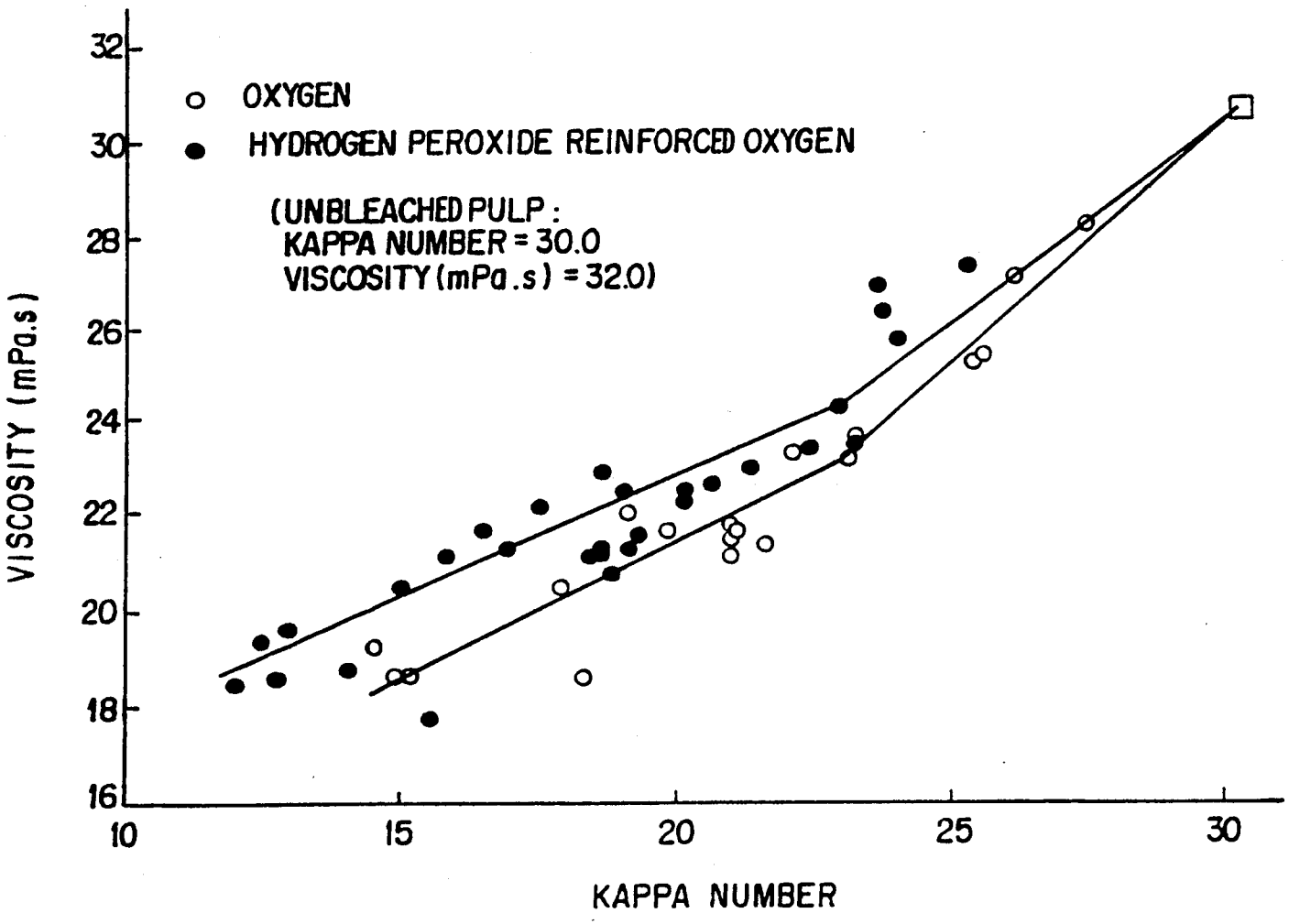
FIG. 1 compares the Kappa No. and viscosity of a conventional oxygen process to the hydrogen peroxide reinforced oxygen process of the invention at different reaction conditions.

The best mode of practicing the invention will be clear to one skilled in the art from the following examples which are presented to illustrate, but not limit the invention.

Southern (loblolly) pine kraft pulps (Kappa number=28.3 and 30.0 and viscosity=24.0 and 32.0 mPas respectively) were used for oxygen delignification. The brightness of the unbleached pulp was 22.4% and 24.0% ISO units respectively. Kappa number and viscosity for both unbleached and delignified pulps were determined by TAPPI Standard procedures (Kappa Number T 236 os-76 and viscosity T 230 Om-82). The unbleached pulp was delignified with acid chloride prior to viscosity determination. Brightness was measured by the ISO procedures (ISO 2469 and 470).

EXAMPLE I

The oxygen delignification of pulps was carried out by the procedure described in Chang et al., TAPPI 56, (9)116(1973). In hydrogen peroxide reinforced oxygen delignification, hydrogen peroxide was added before oxygen injection. Conditions for oxygen delignification and hydrogen peroxide reinforced oxidative extraction are listed in Table I.

EXAMPLE II

Preliminary investigation of the effect of hydrogen peroxide reinforced two-stage oxygen delignification was carried out on a pulp of Kappa number 28.3 which had a rather low viscosity of 24.0 mPas. The properties of the single and two-stage delignified pulps are listed in Table II.

As demonstrated in Table II, reinforcement with hydrogen peroxide resulted in two-stage oxygen delignification pulps with lower Kappa number but an unexpected higher viscosity!

The improvements in the pulp properties after the two-stage delignification are to be interpreted with respect to the properties of the unbleached pulp which had a low viscosity to start with. It was observed that the mode of addition of hydrogen peroxide is important and that it has to be at the first oxygen stage to obtain pulps with lower Kappa number and higher viscosity as compared to pulps delignified with oxygen alone. For example, compared to 0-PO, the PO-0 pulps which received reinforcement at the first stage had better properties in terms of Kappa number reduction and improved viscosity. Further, it was found that charges of hydrogen peroxide higher than 0.5% on o. d. pulp did not bring additional improvements in Kappa number reduction or viscosity.

Anderson and Hook "1985 Pulping Conference", TAPPI Press, Atlanta, page 445, found that addition of oxygen and or peroxide to an alkali extraction stage enhances removal of lignin from pulp, thus lowering the C-E Kappa number whereby pulps can be further bleached with less chlorine dioxide to brightness values of 89%+. They pointed out that the combination of oxygen and peroxide was more selective in removing lignin from pulp than either oxygen or peroxide alone. Alkali extraction of pulps are carried out at lower temperature and alkali charge than those applied at oxygen delignification. Despite the similarities between oxygen bleaching or delignification and oxidative extraction, in case of oxygen bleaching or delignification, the delignification is carried out on unbleached pulps which are not sensitized by chlorine. Process variables, particularly alkali and hydrogen peroxide charge, reaction temperature and time are critical for producing lignocellulose fibers with the desired properties.

EXAMPLE III

Studies were carried out on a pulp of Kappa number 30 and viscosity 32 mPas using a full factorial central composite rotatable second order design for both oxygen and hydrogen peroxide reinforced oxygen delignification of pulps (NaOH=1.5 and 3.0%, $H_2O_2$=0.2% and 0.5%, temperature=80° C. and 110° C., time=30 and 60 minutes).

The results show that regardless of reaction conditions at any given Kappa number, the viscosity of the PO pulps were higher than found in 0 pulps, as shown in FIG. 1.

At the highest levels of the process variables, that is, 3.0% NaOH charge, 110° C. and 60 minutes of reaction time, a Kappa reduction of 50% is possible with one stage 0 bleaching. On the other hand, hydrogen peroxide addition of 0.5% to an oxygen stage (PO delignification) resulted in a Kappa reduction of 60%. The factor effect of hydrogen peroxide charge and time at temperature on Kappa number was not significant within the operating domain. However, the cross products of alkali and hydrogen peroxide charge had a significant two-factor effect. Increasing the hydrogen peroxide charge from 0.2% to 0.5% or increasing the reaction time from 30 to 60 minutes resulted only in marginal reduction in Kappa number or improvement in viscosity. Pulps of Kappa number 14 (decrease of Kappa number=53%) were obtained at 3% NaOH and 0.2% hydrogen peroxide charge, 110° C., and 30 minutes of reaction time. The Kappa number of the reference oxygen pulp was 15.6.

One of the most important factors which influenced the Kappa number reduction and viscosity improvements in the first delignification stage was the caustic charge. Its effect on Kappa number-viscosity of 0 and PO pulps is demonstrated in FIG. 2.

Figure 2:
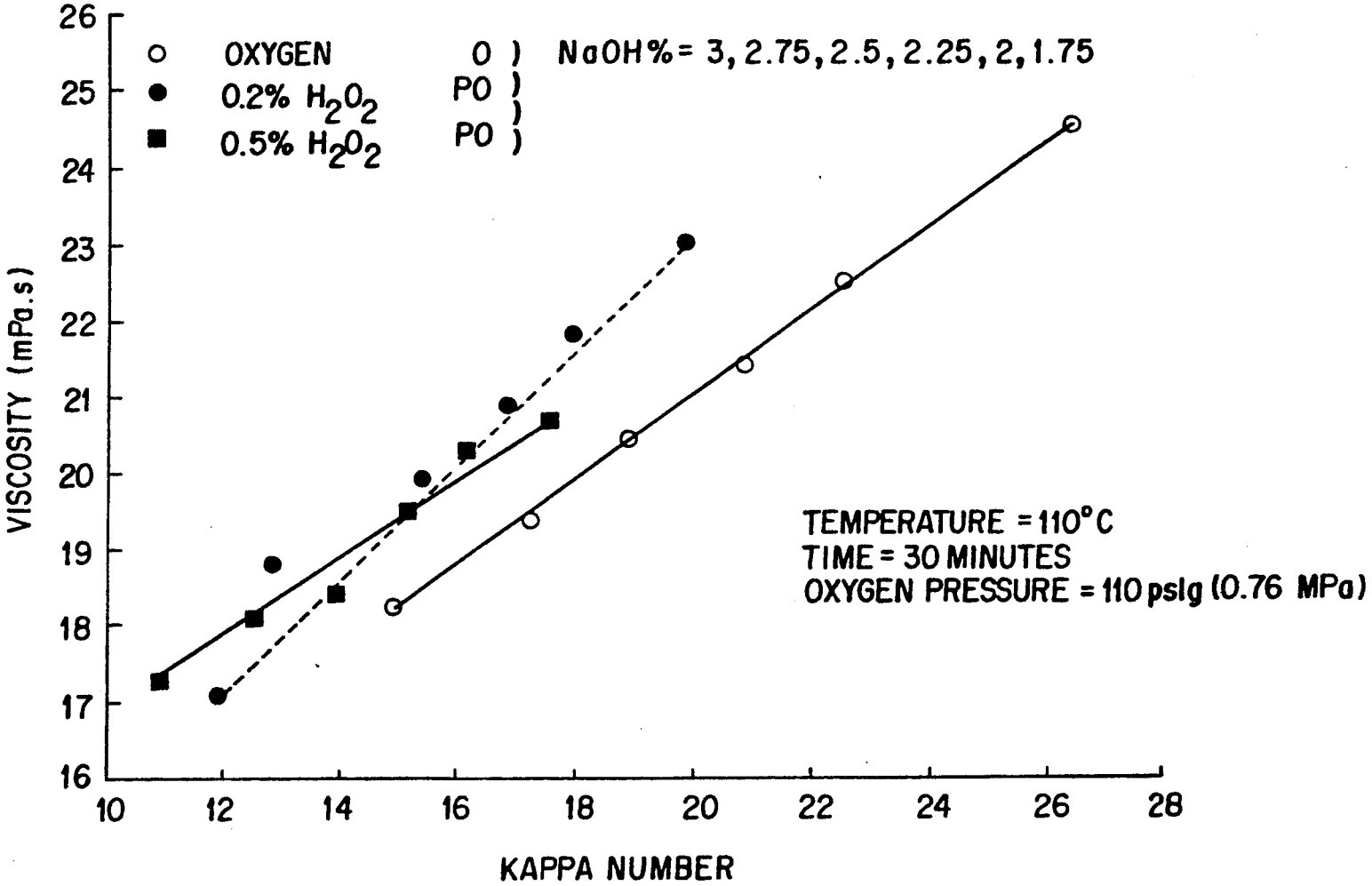
FIG. 2 compares the Kappa No. and viscosity of a conventional oxygen process to the hydrogen peroxide reinforced oxygen process of the invention for different caustic charges.

Pulps of lower Kappa number but with the same viscosity or same Kappa number with higher viscosity can be obtained at lower alkali charge in PO as compared to 0 bleaching (FIG. 2). For example, PO pulps delignified with caustic charge of 2.75%, have a Kappa number of 13.5 and a viscosity of 19 mPas, whereas at this caustic charge the oxygen bleaching would yield a pulp of Kappa number 17.5 and viscosity of 19.6 mPas. Also, PO pulps, required 0.4% less caustic charge (14.5% reduction) to reach the target Kappa number of 15, a delignification of 50%; but at this Kappa number the viscosity of PO pulp would be expected to be at least 1.5 mPas higher than the 0 pulp.

Figure 3:
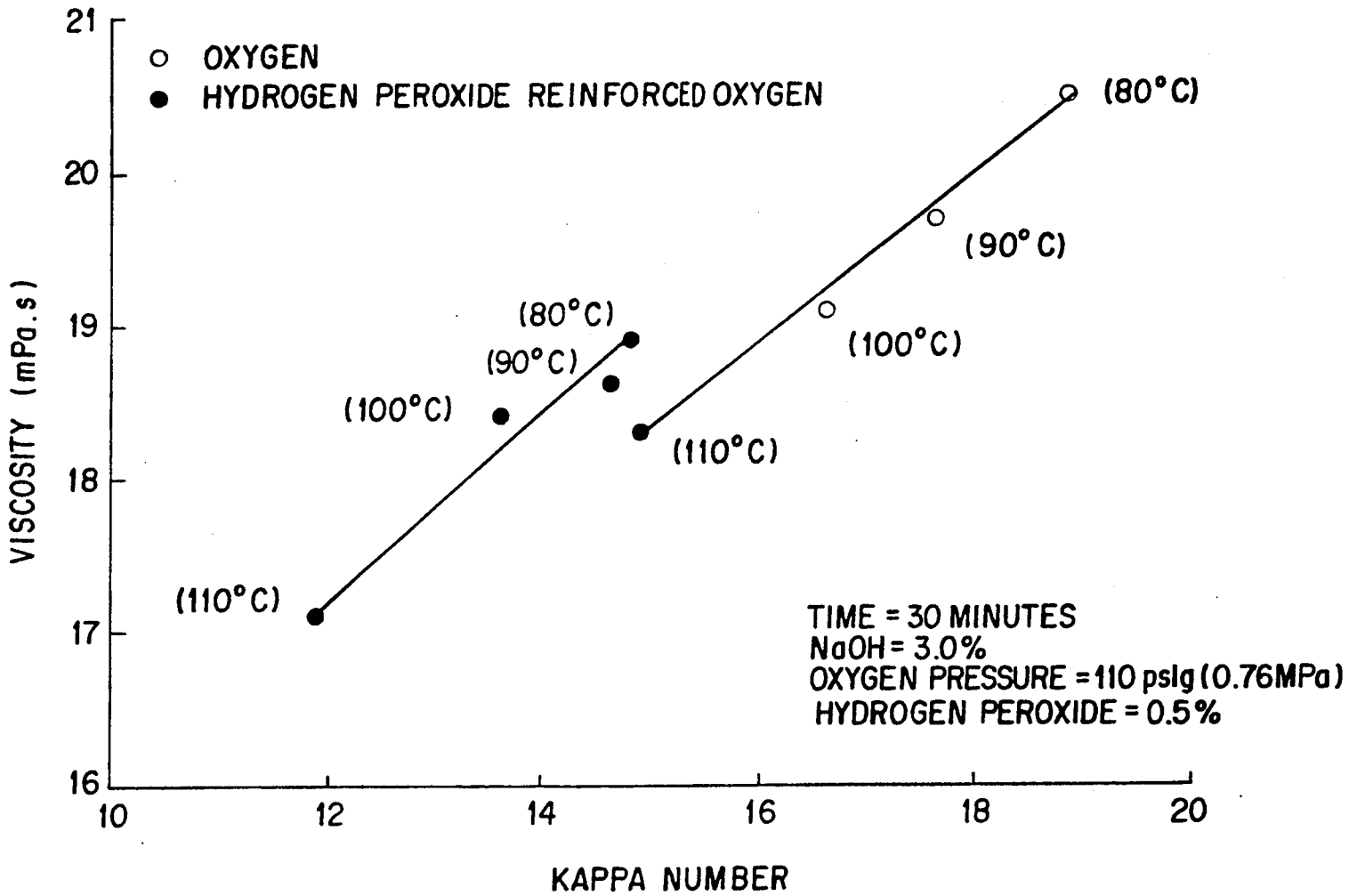
FIG. 3 compares the Kappa No. and viscosity of a conventional oxygen process to the hydrogen peroxide reinforced oxygen process of the invention and shows the effect of reaction temperature.

Another factor which strongly affected the Kappa number and viscosity of PO pulps is the reaction temperature. In a mill situation, reduction in reaction temperature translates into direct savings in steam and thermal energy cost. This reduction in temperature can offset costs of additional chemicals required to enhance delignification. The effect of reaction temperature on 0 and PO bleaching is given in FIG. 3.

To obtain a pulp with a Kappa number of 15 from an unbleached pulp of Kappa number 30, a single stage 0 bleaching has to be carried out at 3% caustic charge for 30 minutes at 110° C. Whereas, under similar conditions, with a hydrogen peroxide reinforcement of 0.2% on o. d. (oven dried) pulp, the PO bleaching can be carried out at 80° C., to get to the same Kappa number. Moreover, as discussed earlier, a higher viscosity PO pulp can be obtained at this Kappa number than by mere oxygen delignification.

Oxygen delignified pulps (3% NaOH, 110° C. and 30 minutes) with and without oxygen peroxide reinforcement were further delignified in a second stage with oxygen or hydrogen peroxide reinforced oxygen. Hydrogen peroxide reinforced oxidative extraction was also investigated. The results are summarized in Table III.

By employing a two-stage hydrogen peroxide reinforced oxygen delignification (PO-PO) Kappa reductions of around 72% are possible while maintaining the pulp viscosity at the level of 0-0 delignification. On the other hand, by a two-stage 0-0 process, the delignification achieved was only around 61%. Comparing the 0-PO delignification to a PO-0 process, the latter resulted in more complete delignification. Moreover, the viscosity of the delignified pulps from the PO-0 treatment was higher, confirming our earlier observation that the mode of addition of hydrogen peroxide is important for achieving better delignification and viscosities. Further, it was shown that a single stage hydrogen peroxide reinforced oxidative extraction of PO pulps has the same effect as a two-stage 0-0 delignification.

Two-stage D-P bleaching of delignified pulps gave a final brightness of 83.7% for PO-PO pulps while D-P bleaching of 0-0 pulps produced 79.7% brightness. The conditions for chlorine dioxide and hydrogen peroxide bleaching are summarized below.

Two-stage bleaching of oxygen and hydrogen peroxide reinforced oxygen delignified pulps: Bleaching conditions:

| Chlorine Dioxide (D) | Hydrogen Peroxide (P) |
|---|---|
| Consistency = 10% | Consistency = 12% |
| Chlorine dioxide = 1.5% | NaOH = 0.5% |
| (as act. $Cl_2$) | $H_2O_2$ = 1.0% |
| Time = 1.5 hours | Sodium silicate = 1.0% |
| Temperature = 70° C. | $MgSO_4$ = 0.25% |
| | Temperature = 70° C. |
| | Time = 1.0 hour |

Sequences: 0-0-D-P, PO-PO-D-P, 0-(EP)0-D-P and PO-(EP)0-D-P.

TABLE I

Conditions at Oxygen and Oxygen Reinforced Alkaline Extraction (Chemical Charges are on O.D. Pulp Basis)

| | Oxygen (O & PO) | Oxygen Reinforced Alkaline Extraction (EO & (EP)O) |
|---|---|---|
| Consistency (%) | 20.0 | 20.0 |
| Sodium Hydroxide (%) | 1.5–3.0 | 2.0 |
| Hydrogen Peroxide (%) | 0.0–0.50 | 0–0.50 |
| $MgSO_4$ (%) | 0.50 | 0.50 |
| Temperature (°C.) | 80–110 | 70 |
| Time to Temp. (min.) | 10 or 13 | 10 |
| Time at Temp. (min.) | 30–60 | 60 |
| Oxygen Pressure (mPa) | 0.76 | 0.14* |

*Oxygen was released after 20 minutes at temperature.

TABLE II

Two-Stage Hydrogen Peroxide Reinforced Oxygen Delignification (Unbleached pulp: Kappa number = 28.3, Viscosity = 24.0 mPas and Brightness = 22.4% ISO)

| Pulp | NaOH (%) | $H_2O_2$ (%) | Temp. (°C.) | Kappa No. | Viscosity (mPas) | Brightness (% ISO) |
|---|---|---|---|---|---|---|
| | | First Stage Delignification | | | | |
| O | 2.0 | 0 | 86 | 18.2 | 15.3 | 32.3 |
| PO | 2.0 | 0.2 | 85 | 17.4 | 18.9 | 32.9 |
| | | Second Stage Delignification | | | | |
| O-O | 2.0 | 0 | 85 | 17.8 | 13.8 | 33.0 |
| O-PO | 2.0 | 0.5 | 85 | 16.9 | 14.7 | 33.5 |
| O-PO | 2.0 | 1.0 | 85 | 16.8 | 14.2 | 33.8 |
| PO-O | 2.0 | 0 | 85 | 16.2 | 17.6 | 35.5 |
| PO-PO | 2.0 | 0.5 | 85 | 15.8 | 18.2 | 38.8 |
| PO-PO | 2.0 | 1.0 | 85 | 16.0 | 17.9 | 39.2 |

TABLE III

Summary of Pulp Properties from Two-Stage Delignification

| Pulp | Temp. at 2nd Stage (°C.) | Total Time (hrs) | Total NaOH (%) | Total $H_2O_2$ (%) | Kappa No. | Pulp Properties Viscosity (mPas) | Pulp Properties Brightness (% ISO) |
|---|---|---|---|---|---|---|---|
| O-O | 110 | 1.0 | 6.0 | 0.0 | 11.6 | 16.0 | 43.2 |
| O-PO | 110 | 1.0 | 6.0 | 0.5 | 10.9 | 15.1 | 42.7 |
| O-(EP)O | 70 | 1.5 | 5.0 | 0.2 | 14.2 | 16.4 | 38.5 |
| PO-O | 110 | 1.0 | 6.0 | 0.5 | 9.8 | 15.6 | 44.4 |
| PO-PO | 110 | 1.0 | 6.0 | 0.5 | 8.5 | 15.9 | 47.4 |
| PO-(EP)O | 70 | 1.5 | 5.0 | 0.4 | 12.3 | 17.2 | 40.2 |

We claim:

1. A process employing molecular oxygen for unbleached delignifying lignocellulose fibers in a slurry from a digester without significant loss of fiber strength consisting essentially of the steps of:

a. thickening the unbleached slurry from a digester by extracting therefrom a first liquor portion, b. incorporating sufficient thickened slurry from step (a) into a first reaction mixture to provide a consistency of from about 8% to about 25% by weight fibers on an oven dry basis, said reaction mixture also containing sufficient alkalinity to be equivalent to from about 1.5% to about 4% sodium hydroxide and about 0.01% to about 1% of hydrogen peroxide based on the oven dry weight of fibers, c. maintaining the first reaction mixture at a temperature of about 80° C. to about 110° C., for about 30 to about 60 minutes in the presence of molecular oxygen at a partial pressure of about 620 to 860 kPa, d. thickening the first reaction mixture from step (c) by extracting therefrom a second liquor portion, e. incorporating sufficient thickened slurry from step (d) into a second reaction mixture to provide a consistency of from about 8% to about 25% by weight fibers on an oven dry basis, said reaction mixture also containing sufficient alkalinity to be equivalent to from about 1.5% to about 4% sodium hydroxide and 0% to 0.5% hydrogen peroxide, f. maintaining the second reaction mixture at a temperature of about 70° C. to about 110° C. for about 30 to about 60 minutes in the presence of molecular oxygen at a partial pressure of about 170 to 860 kPa, and g. recovering delignified fibers from the second reaction mixture, said delignified fibers having equal or increased strength compared with the fibers delignified by a single oxygen stage.

2. The process of claim 1 wherein the second reaction mixture also comprises 0.01% to about 1% hydrogen peroxide based on the oven dry weight of the fibers.

3. The process of claim 1 wherein the first reaction mixture contains 0.1% to 0.5% hydrogen peroxide.

4. The process of claim 2 wherein the second reaction mixture contains 0.1% to 0.5% hydrogen peroxide.

5. The process of claim 2 when both the first and the second reaction mixture contain 0.1% to 0.5% hydrogen peroxide.

6. In a process for bleaching delignified unbleached lignocellulose fibers in a slurry from a digester by a chlorine dioxide stage followed by a peroxide stage, the improvement consisting essentially of delignifying the lignocellulose fibers in a slurry from a digester by the steps of:

a. thickening the unbleached slurry from a digester by extracting therefrom a first liquor portion, b. incorporating sufficient thickened slurry from step (a) into a first reaction mixture to provide a consistency of from about 8% to about 25% by weight fibers on an oven dry basis, said reaction mixture also containing sufficient alkalinity to be equivalent to from about 1.5% to about 4% sodium hydroxide and about 0.1% to about 1% of hydrogen peroxide based on the oven dry weight of fibers, c. maintaining the first reaction mixture at a temperature of about 80° C. to about 110° C., for about 30 to about 60 minutes in the presence of molecular oxygen at a partial pressure of about 620 to 860 kPa, d. thickening the first reaction mixture from step (c) by extracting therefrom a second liquor portion, e. incorporating sufficient thickened slurry from step (d) into a second reaction mixture to provide a consistency of from about 8% to about 25% by weight fibers on an oven dry basis, said reaction mixture also containing sufficient alkalinity to be equivalent to from about 1.5% to about 4% sodium hydroxide and 0% to 1.0% hydrogen peroxide, f. maintaining the second reaction mixture at a temperature of about 70° C. to about 110° C., for about 30 to about 60 minutes in the presence of molecular oxygen at a partial pressure of about 170 to 860 kPa, and g. recovering delignified fibers from the second reaction mixture, said delignified fibers having increased strength compared with the fibers from the digester slurry.

7. The process of claim 6 wherein the second reaction mixture also comprises 0.1% to 1% hydrogen peroxide based on the oven dry weight of the fibers.

8. The process of claim 6 wherein the first reaction mixture contains 0.1% to 0.5% hydrogen peroxide.

9. The process of claim 7 wherein the second reaction mixture contains 0.1% to 0.5% hydrogen peroxide.

10. The process of claim 7 when both the first and the second reaction mixture contain 0.1% to 0.5% hydrogen peroxide.

* * * * *

UNITED STATES PATENT AND TRADEMARK OFFICE

CERTIFICATE OF CORRECTION

PATENT NO. : 5,011,572

DATED : April 30, 1991

INVENTOR(S) : V.R.Parthasarathy; Meenaksi Sundaram; Hasan Jameel, Josef S. Gratzl and Ronald J. Klein It is certified that error appears in the above-identified patent and that said Letters Patent is hereby corrected as shown below:

Column 2, line 65, "number $\geqq$ 50)" should read --number $\geq$50)--.
Column 3, line 69, "(ISO 2469 and 470)." should read --(ISO 2469 and 2470)--.

Column 8, line 14, "bleaching delignified unbleached" should read --bleaching unbleached delignified--.

Signed and Sealed this

Twenty-ninth Day of September, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,011,572

DATED : Apr. 30, 1991

INVENTOR(S) : V.R. Parthasarathy et al

It is certified that error appears in the above-indentified patent and that said Letters Patent is hereby corrected as shown below:

Column 3, line 69, "(ISO 2469 and 470)." should read —(ISO 2469 and 2470)—. Column 7, line 44, "and 0% to 0.5%

Signed and Sealed this

Fourteenth Day of September, 1993

Bruce Lehman

*Attest:*

BRUCE LEHMAN

*Attesting Officer*

*Commissioner of Patents and Trademarks*